US010042382B2

(12) United States Patent
Astrom et al.

(10) Patent No.: US 10,042,382 B2
(45) Date of Patent: Aug. 7, 2018

(54) JOYSTICK

(71) Applicant: Parker Hannifin Manufacturing Sweden AB, Boras (SE)

(72) Inventors: Hasse Astrom, Njurunda (SE); Stefan Mikaelsson, Matfors (SE); Stephan Johansson, Sjomarken (SE)

(73) Assignee: Parker Hannifin Manufacturing Sweden AB, Boras (SE)

( * ) Notice: Subject to any disclaimer, the term of this patent is extended or adjusted under 35 U.S.C. 154(b) by 613 days.

(21) Appl. No.: 14/436,981

(22) PCT Filed: Oct. 1, 2013

(86) PCT No.: PCT/SE2013/051142
§ 371 (c)(1),
(2) Date: Apr. 20, 2015

(87) PCT Pub. No.: WO2014/065741
PCT Pub. Date: May 1, 2014

(65) Prior Publication Data

US 2015/0253806 A1 Sep. 10, 2015

(30) Foreign Application Priority Data

Oct. 22, 2012 (SE) ..... 1251192

(51) Int. Cl.
*G05G 9/00* (2006.01)
*G05G 9/047* (2006.01)
*G05G 5/05* (2006.01)

(52) U.S. Cl.
CPC ..... *G05G 9/04788* (2013.01); *G05G 5/05* (2013.01); *G05G 2009/04774* (2013.01); *Y10T 74/20201* (2015.01)

(58) Field of Classification Search
CPC ..... E02F 9/202; E02F 3/3631; E02F 5/326; F16H 19/02; Y10T 74/18056
See application file for complete search history.

(56) References Cited

U.S. PATENT DOCUMENTS

2006/0274040 A1 12/2006 Passaro et al.

FOREIGN PATENT DOCUMENTS

JP H09128085 A 5/1997
WO 98/53379 A1 11/1998

OTHER PUBLICATIONS

International Search Report dated Jan. 30, 2014 for corresponding International application No. PCT/SE2013/051142.

(Continued)

*Primary Examiner* — Victor L MacArthur
(74) *Attorney, Agent, or Firm* — Renner, Otto, Boisselle & Sklar, LLP

(57) ABSTRACT

Joystick for maneuvering of a utility vehicle, wherein said joystick (1) at least comprises: a lever arm, a base, a grip body, and a rocker, wherein said lever arm is arranged such that it can tilt relative said base, said grip body (4) is fixedly arranged relative said lever arm, wherein said grip body is provided with a grip portion, which at least facilitates gripping of said grip body with a thumb and an opposite finger, and said rocker is provided in the area of said grip portion and can pivot relative said grip body wherein a control ring is provided below said grip portion and arranged such that it can pivot relative an axis essentially parallel with the central axis of said lever arm and relative said grip body, wherein said grip body is provided upon a carrier, wherein said carrier is fixedly attached to said lever arm and comprises a base part, a holder and sensing means, where said holder extends from said base part in a direction essentially parallel to the central axis of said lever arm, said grip body essentially extends from said base part such that it encloses (Continued)

said holder, and where said sensing means are provided within said holder, and is adapted to sense movement of at least said control ring and said rocker.

14 Claims, 7 Drawing Sheets

(56) References Cited

OTHER PUBLICATIONS

English translation of Chinese Office Action for corresponding Chinese application No. 2013800552231, dated Apr. 6, 2016.

JOYSTICK

TECHNICAL FIELD

The present invention relates to an joystick for maneuvering a utility vehicle, wherein the joystick at least comprises a lever arm for control input of at least a first function and a second function, dependent on a tilt direction of the lever arm, a base in which the lever arm is arranged such that it can tilt relative the base, a grip body fixedly arranged relative the lever arm, and a control ring for control input of a third function, wherein the control ring is arranged such that it can rotate upon and relative the grip body.

BACKGROUND ART

Maneuvering and operating of utility vehicles, such as excavators, snow groomers, forestry machines, cranes and construction machines, are often controlled by the operator via an operating lever device i.e. a joystick. Hydraulic systems were previously used but electronic control systems are becoming more common. Depending on type of utility vehicles the joystick needs to control several different operational commands i.e. functions. The first function of the joystick is commonly controlled by the movement of the lever arm of the joystick relative the base on which it is arranged. Other functions may be controlled by buttons or knobs arranged on the grip body of the joystick.

Currently, operators need to move several levers simultaneously in order to perform the movements for the utility vehicle. This requires moving the grip between different levers, i.e. joysticks and the results is lost productivity and less user friendliness. Hence, there is a need for a multifunctional joystick.

One multifunctional joystick is described in WO00/36250, controlling the operation of a snow groomer. The multifunction joystick is adapted to select specific functions of a work implements and apply the movements of the joystick to these specific functions. Moreover, the speed of the snow groomer is controlled by rotation of a knob, intended to be rotated by movement of the users thumb.

EP1462408B1 describes a joystick in which an operating member is arranged at the top of the grip body of the joystick. The operating member is preferably allowed to rotate around a central axis ax extending along a longitudinal direction of the grip body. Thereby, the operational member may be rotated and hence controlled by the users thumb or index finger. When controlling the rotatable operational member, the operator must loosen its grip of the grip body, either to control it with the thumb or with the index finger; the operator has thereby harder to control other functions of the joystick simultaneously. Further, the operator is subjected to additional movements in, the wrist, the arm and the shoulder, due to the repositioning of the hand in order to control the rotatable operational member.

A joystick having a rocker as an input for an additional control function is described in WO 98/53379.

The operator/user of such a utility vehicle is sometimes operating the vehicle for during of an entire work shift. Hence, the driver uses the joystick for an extensive period of time and the ergonomics and the user friendliness of the joystick and the easiness of command execution is thus of high importance, in order to assure that the operator is not subjected to wear damages. There is a desire of implementing more control functions in a joystick. The implementation of more controls functions conflicts with the intention of keeping the joystick ergonomic, due to the space requirements of the added control functions.

SUMMARY OF THE INVENTION

The object of the invention is to provide a multifunction joystick with improved ergonomics and user friendliness. This object is achieved by the subject-matter as set forth in the independent claim 1.

The present invention provides a joystick for maneuvering/operation of a utility vehicle, wherein the joystick at least comprises a lever arm for control input of at least a first function and a second function, a base in which the lever arm is arranged, such that it can tilt relative the base, a grip body fixedly arranged relative the lever arm, and a control ring for control input of a third function, wherein the control ring is arranged such that it can rotate upon and relative the grip body. The grip body is provided with a grip portion, which at least facilitates gripping of the grip body with a thumb and an opposite finger, i.e. a pincher grasp or similar.

The first and the second function are defined by a first and a second tilt direction of the lever, each tilt direction is defined as a back and forth direction. The first, second and third function, can be any suitable function, depending of the settings of the joystick. A function is an operation command, such as left, right, forward, backward and lower, higher, etc. The control ring is provided below the grip portion, such that a maneuvering of the control ring with a little finger or an adjacent finger is facilitated. By placing the control ring below the grip portion of the handle, the control ring can be control by the little or the ring finger, which normally does not have much influence of the rigidity of the grip about the joystick. The joystick lever arm can thereby be control simultaneously as the control ring, with an intact grip about the grip body. The ergonomics of the joystick is increased, since the operator does not have to change grip, in order to control the function associated with the control ring.

The grip body may further be provided with a rocker, which can pivot relative the grip body for control input of at least a fourth function. The rocker enables the joystick to have an additional function, i.e. a fourth function. By placing the rocker accessible upon the grip body, all the four functions are easily accessible on the joystick. The rocker is pivoted such that it has a middle starting position and can pivot in two directions there from. It is preferred that a resilient member is acting such upon the rocker that the rocker always returns to its starting position, when it is not subjected to any operational forces.

The rocker is preferably provided at the side of the grip portion of the grip body, at which the thumb of the hand gripping the joystick is placed. Hence, it is easily accessible to the thumb of an operator gripping the grip body, whereby also the rocker can be operated simultaneously as the lever arm and the control ring.

The functions of the utility vehicle are controlled by the lever arm, the rocker and the control ring. Having the possibility to control four functions from the joystick enable a full operation of a vehicle with just the use of one or two joysticks, wherein the number of control means within an operator cabin can be minimized. Further, the ergonomics for the operator is improved, because there is less movement between different controls.

The top surface of the grip body may be dished such that a resting area for a finger is provided thereupon. The dished area creates a recess in the top surface, which is adapted for providing support for the weight of the operator's hand. The operator can thereby use the joystick and rest for example the index finger in the dished area, as a support for the hand controlling the joystick. Obviously, another finger can be placed in the dished area with the same result. The resting area for the index finger prevents the hand of the operator from sliding of the grip body and towards the lever arm. The recess/dished area may have an elongated shape with two essentially parallel edges, defining the recess. The elongated shape facilitates a comfortable position of the finger in the recess, and ensures that the finger stays in the dished area/recess even when subjected to side forces. It is preferred that the recess is convex in its length direction and concave in its width direction.

The control ring may be provided with a high friction material and/or recesses and/or rills. The use of high friction material, recesses or rills is beneficial because it improves the maneuvering of the control ring by enabling a distinct grip between fingers and control ring whereby an easy turning of the control ring is facilitated. Rubber and silicon are two examples of suitable materials that may be used to increase the friction between the control ring and a finger of the user. Patterns, such as depressions and ridges, in the material provided on the control ring are also possible. Patterns may facilitate the distinct grip and easy turning of the control ring by a finger.

The rotational axis of the control ring is parallel with a central axis of the lever arm. It is thereby easily turned by the little finger or an adjacent finger when the grip body is gripped.

The control ring may be of different shapes, e.g. round or squared.

The control ring may be provided with a spare, provided such that it from its starting position can be turned a maximum predetermined angle in each direction. The spare thereby limits the turning angle of the control ring. Moreover the control ring may be provided with a resilient member, which is acting upon the control ring, such that it automatically returns to its starting position. It is preferred that the control ring has the same maximum turning angle in both direction from the starting position.

The grip body is preferably provided upon a carrier, wherein the carrier is moulded in piece and comprises potted electronics, which register control inputs of said joystick. By providing the electronics in said carrier in a potted manner, the electronics are protected from water and dust which are common in the working environment of the joystick.

The carrier may also be assembled from more than one part. The carrier is further attached to the lever arm.

The carrier comprises a base part having guides for the control ring. Said guides are provided such that they guide the rotary movement of the control ring. The base part is carrier further provided with a holder extending from the base part such that the grip body can be attached thereto in its upper part. The holder encloses the potted electronics and the holder's position facilitates the arrangement of the grip body such that the grip body extends from the base part parallel the holder. The guides in the base part facilitate the movement of the control ring, and the spare is arranged in between the guides.

The holder extends from the base part in a direction essentially parallel to the central axis of the lever arm. The carrier further comprises sensing means provided inside the holder. The sensing means are adapted to sense movement of at least the control ring and the rocker. The grip body encloses the holder and rests upon the base part of the carrier, or extends from the base part. The arrangement of sensing means within the holder enables that the rocker and the control ring can be provided without electronics and just a passive tag, which movements the sensing means can sense. The sensing means is thereby preferably a Hall sensor or the like and the tag is a magnet, whereby the Hall sensor senses the movement of the magnets when the rocker rocks and the control ring is turned respectively.

It is further preferred that the holder is arranged with an offset to the central axis of the lever arm and thereby upon the carrier. The offset placement of the holder enables the rocker to be arranged centrally in the grip body without its movements interfere with the holder.

The joystick is designed to be very space efficient, in order to allow an ergonomic form of the joystick. Due to the inventive placement of the sensing means in a holding device, all the electronics of the joystick can be placed below the carrier and thereby efficiently sealed off from the potentially rough, dirty and moist working environment of the joystick. The rocker and the control ring providing the additional control function to the joystick are not provided with any electronics.

A further advantage with the inventive joystick is that a simple production is realised due to the few parts. The sensing means are easily added to the physical structure, which can be produced and assembled separately.

BRIEF DESCRIPTION OF THE DRAWINGS

The invention will be described more fully hereinafter with reference to the accompanying drawings. This invention may, however, be embodied in many different forms and should not be construed as limited to the example set forth herein, wherein.

DETAILED DESCRIPTION

In the following one embodiments of the invention is shown and described, simply by way of illustration of one mode of carrying out the invention.

Figure 1:
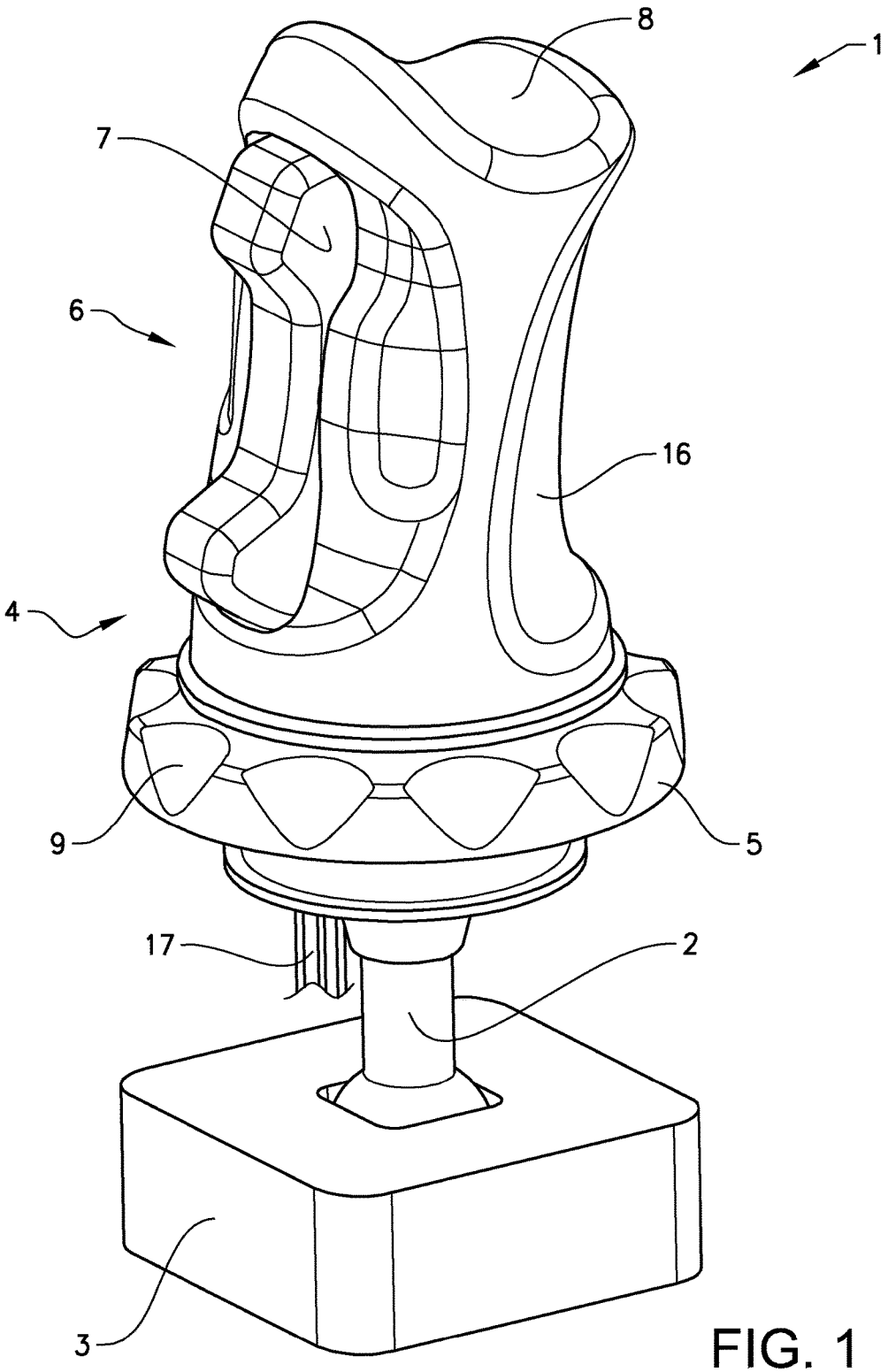
FIG. 1 shows a schematic view of a joystick according to the invention.

An inventive joystick 1 for operating and maneuvering a utility vehicle is shown in FIG. 1.

The joystick 1 comprises a lever arm 2 that may be tilted about a pivot point. The lever arm 2 is arranged on a base 3 such that the lever arm 2 can tilt relative the base 3. The tilt direction of the lever arm 2 controls the input of at least a first function and a second function, e.g. driving and turning direction of a vehicle.

A grip body 4 is fixed on the lever arm 2 and the grip body 4 extends in the direction parallel to the extension to the lever arm 2. The grip body 4 has a grip portion 6 that facilitates gripping of the grip body 4 by the thumb on one side and one or several fingers on the other side. An example of a hand gripping the grip body 4 is disclosed in FIG. 2.

A rotatable control ring 5 is arranged below the grip portion 6 such that if the grip portion 6 is gripped by the thumb and one or several opposite fingers, the little finger or an adjacent finger can thereby easily accesses the control ring 5. The control ring 5 can thereby be rotated by the little finger or an adjacent finger, with a maintained steady grip about the grip body. The rotation of the control ring 5 controls input of a third function.

The grip body 4 of the joystick 1 is also provided with a rocker 7 on one side of the grip portion 6, as seen in FIG. 1. The rocker 7 can pivot relative the grip body 4, and the pivot controls input of at least a fourth function. The rocker 7 has a recess in which a thumb fits; hence the rocker 7 facilitates the positioning of the thumb when an operator is gripping the grip body 4. The rocker 7 has a neutral starting position from which it can pivot in each direction.

The placement of the rocker 7 and the control ring 5 on the grip body 4 enable the operator to maneuver all functions of the joystick, and thus four movements of the vehicle, without changing the handle position. The inventive joystick 1 may thus allow smooth movements of the machine as well as prevent hand, wrist and/or back injuries or ailments in the operators during long working days i.e. decrease the risk of operation repetitive strain injuries.

As seen in FIG. 1 the grip body 4 has a recess/dished area 8 on its top surface, i.e. the surface opposite the elongation of the lever arm 2 and the arrangement of the control ring 5. The recess 8 on the top surface is adapted such that a finger fits therein, i.e. the recess 8 is adopted to provide a resting area for a finger. When an operator is gripping the grip portion 6, the index finger is preferably positioned in the recess 8 on the top surface. The weight of the operators hand can thereby be taken up by the joystick, whereby the wrist of the operator is relieved.

The edges of the recess/dished area 8 are essentially parallel such that a finger remains in the recess 8 during execution of commands, i.e. when the joystick 1 is tilted or the rocker 7 or control ring 5 is used. The grip of the joystick 1 is sturdier when the grip body 4 is gripped on three sides as compared to the two sides or the mantle surface area. A more precise and reliable maneuvering of a utility vehicle is provided with a joystick 1 according to the invention can thereby be achieved, due to the inventive joystick 1.

Figure 2:
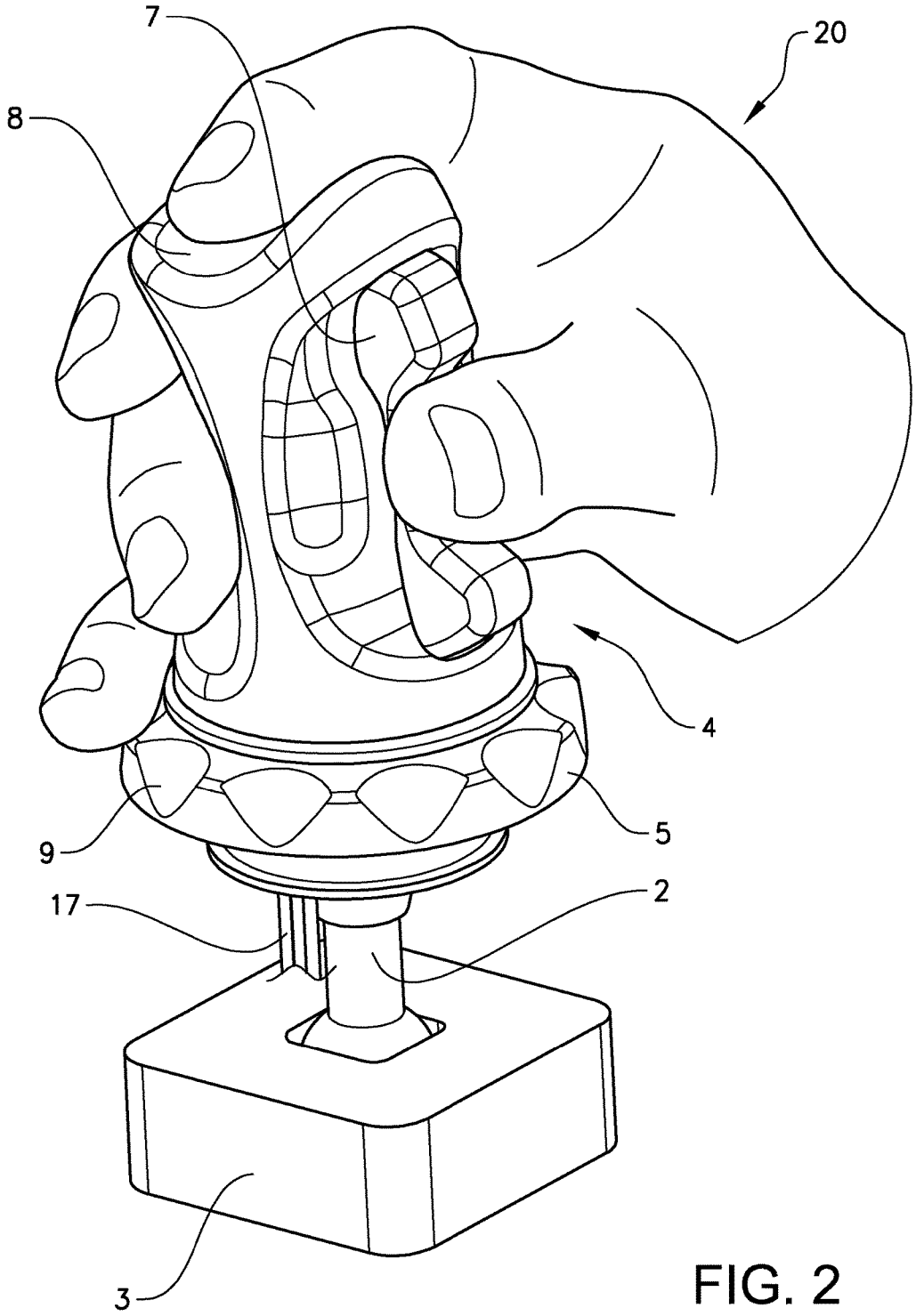
FIG. 2 shows a schematic view of a joystick gripped by a hand of an operator.

Now some of the advantages of the joystick will be explained in conjunction with FIG. 2, in which a hand of an operator gripping the inventive joystick 1 is shown. The combination of having the control ring 5 arranged below the grip portion 6 of the grip body 4 and the recess/dished area 8 on the top of the grip body 4 facilitates a comfortably maneuvering of the control ring 5 for the operator. The operator can maintain the grip of the grip body 4 such that the function associated with lever arm 2 can be controlled. Because the joystick 1 carries the weight of the hand through the resting of the index finger in the recess/dished area 8, the wrist, arm and shoulders of the operator can be relived from some of the weight of the hand and or arm, and the operator can control joystick 1 with the loose grip about the grip body 4. Due to that a loose grip is facilitated the operator can easily control the control ring 5 with the little finger or the ring finger. An operator using the inventive joystick, becomes thereby less strain in the shoulders, wrist and arms, wherein wear injury is prevented.

It is sometimes preferred by a driver of the utility vehicle to grip the joystick 1 with a "pen grip". The grip body 4 is provided with a waist 16, arranged in the grip portion 6 opposite the rocker 7 to facilitate the pen grip when gripping the joystick 1. Thereby, the improved shape and function of the joystick 1 allows for different grips to be used; such as the three-finger grip or the pen grip (not shown).

The control ring 5 is provided with recesses 9 in the figures shown. The size of the recesses should preferably facilitate the positioning of a fingertip, such that the rotation of the ring is facilitated. Further, the recesses 9 are evenly distributed along the outer surface of the control ring 5. The recesses are shaped such that an operator easily takes hold in one of the recesses 9 independently of the position of the control ring 5 relative to the hand of the operator. The control ring 5 may also be provided with a high friction material which increase the friction between the finger and the control ring 5, such that the control ring 5 is easily maneuvered.

In the figures shown, the control ring 5 has a rotational axis parallel with the central axis ax of the lever arm. However the base part 11 and the grip body 4 may also be arranged with an angle to the central axis ax of the lever arm 2, without departing from the scope of the invention.

The grip body 4 is arranged upon a carrier 10, which is attached upon the lever arm 2. The carrier 10 is provided with a base part 11 from which a holder 13 is extending. Further, upon the base part 11 guides 12 are provided, which guides the movement of the control ring 5. The guides 12 have circle segment shape.

Figure 4:
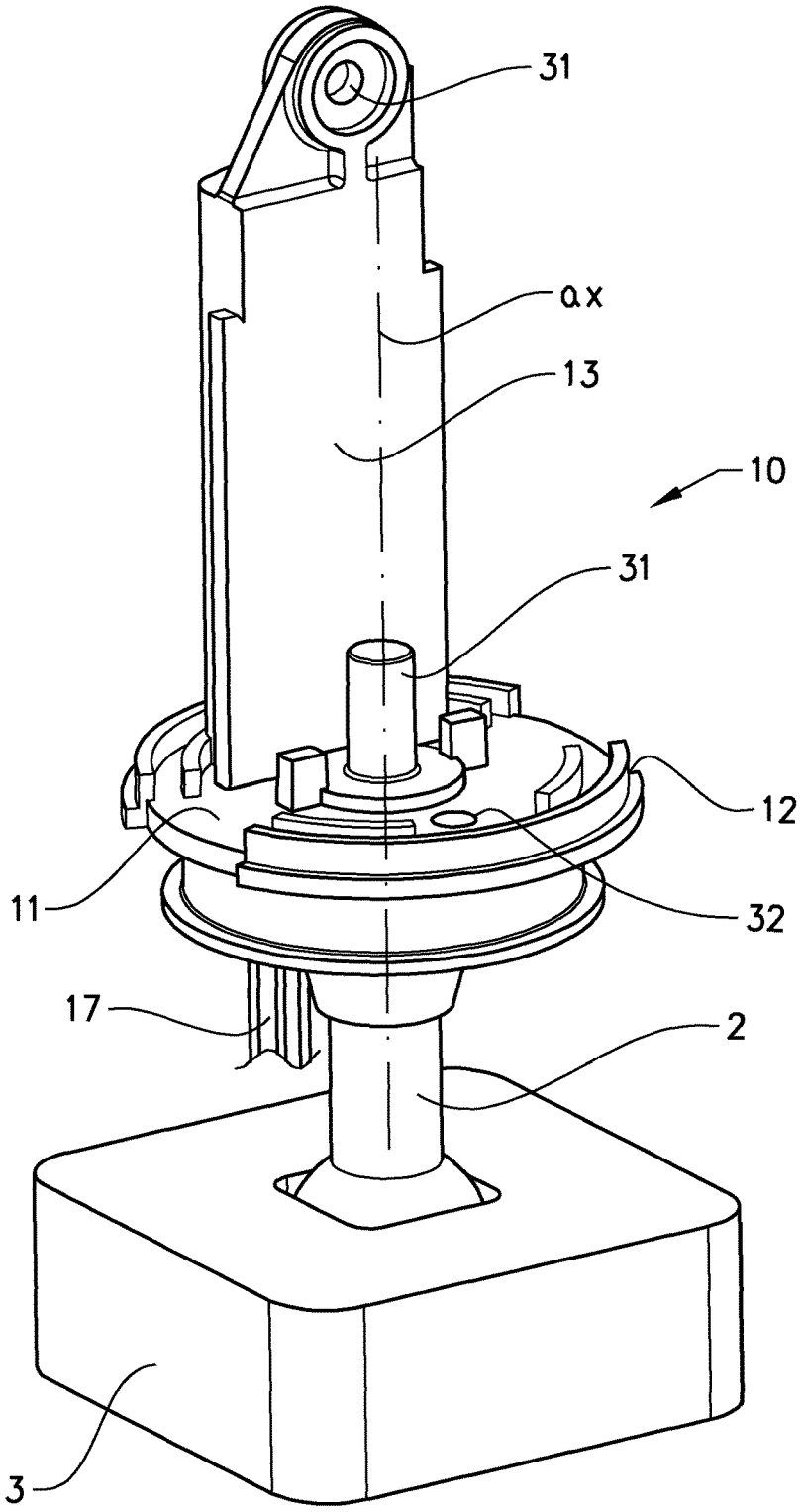
FIG. 4 shows a schematic view of the carrier according to the invention.
Figure 5A:
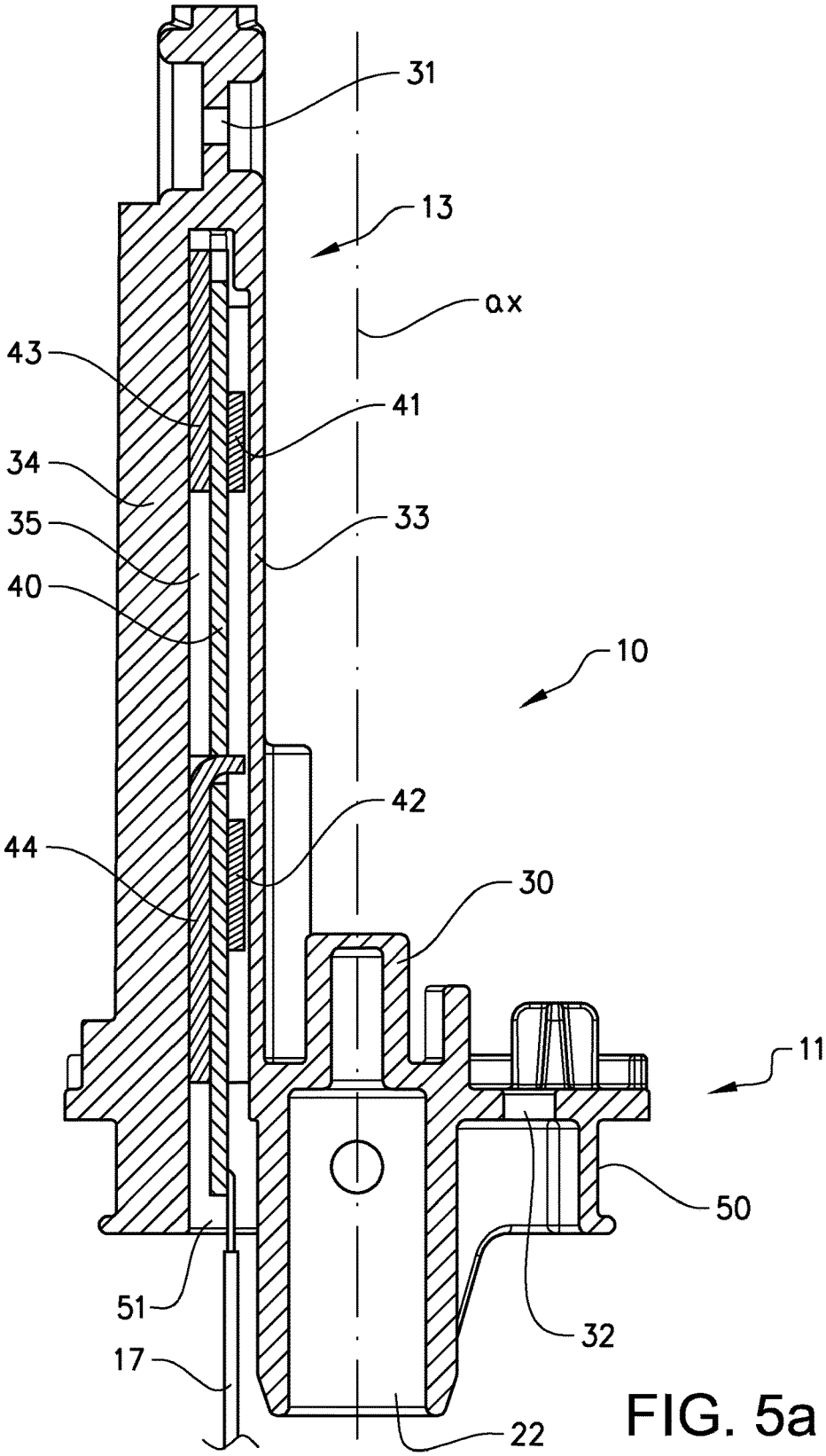
FIG. 5 *a-c* shows three views of the carrier and the circuit board of the invention.
Figure 5B:
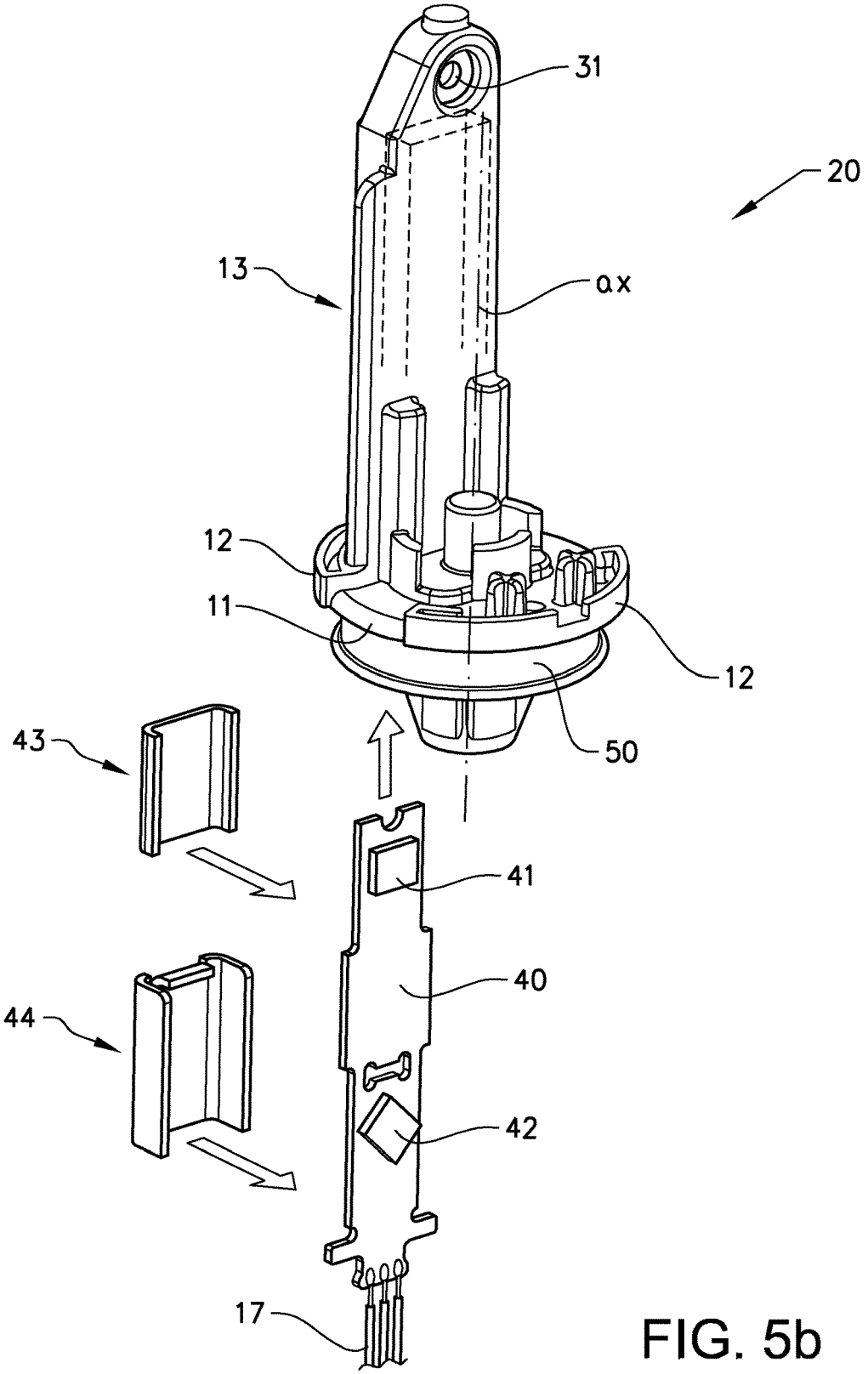
Figure 5C:
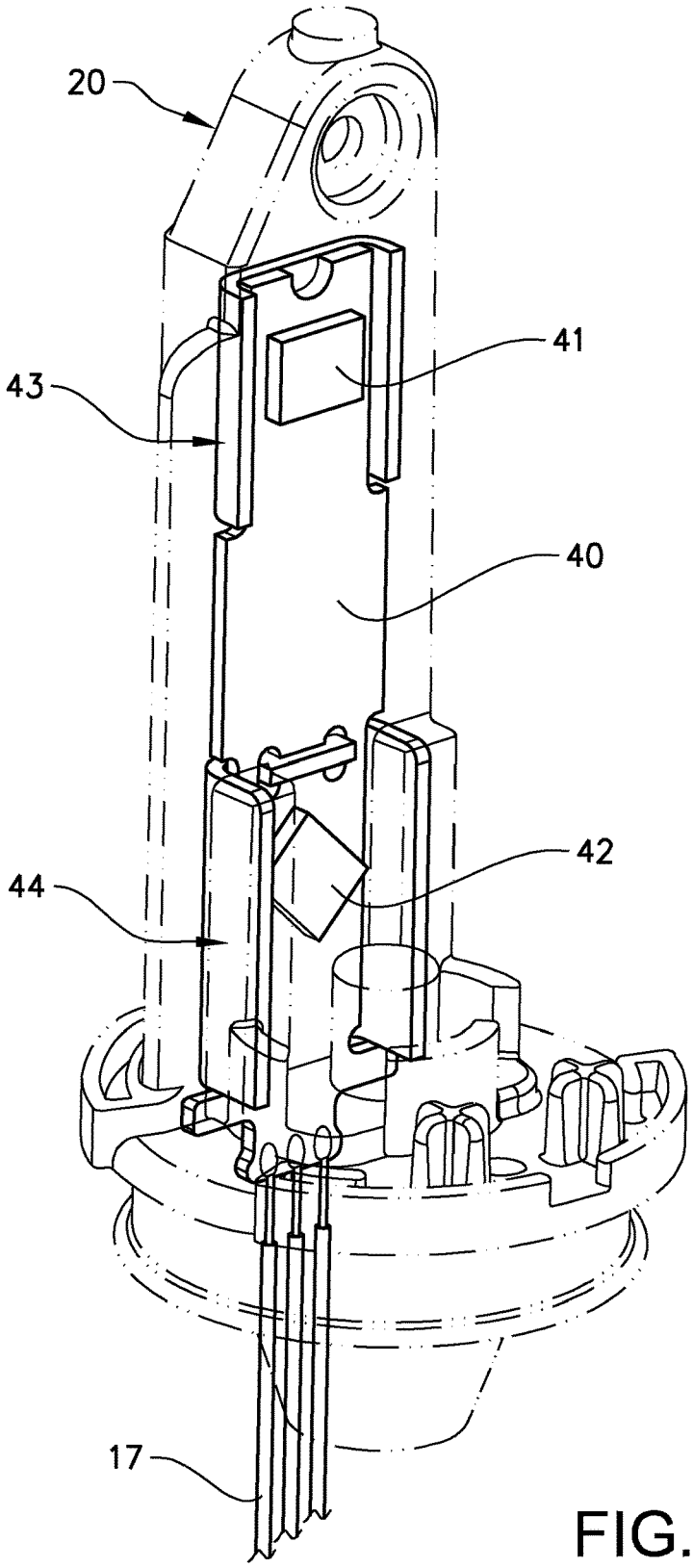

Now the carrier 10 and its features will be explained in conjunction with the FIGS. 4 and 5. The carrier comprises a base part 11 and a there from extending holder 13. The holder 13 extends from the base part 11 in a direction essentially parallel to the central axis ax of the lever arm 2. The main purpose of the holder 13 is to hold and enclose the sensing means 41, 42. However, the holder 13 also functions as structure upon which the grip body 4 can be attached. As disclosed in FIG. 3, the grip body 4 is preferably divided into two separate parts, which are attached to the carrier 10. The two parts can be attached to each other and the holder 13 either by a form fitting (not shown) or preferably by a screw (not shown), the screw can thereby pass through the hole 31 in the upper part of the holder 13. The screw is preferably passing through a first part of the grip body 4 and through the hole in the holder 13 and screwed into the second part of the grip body 4. The second part of the grip body 4 is preferably also fixed to the base 11 of the carrier by a second screw (not shown) which passes through the hole 32 in the base 11 of the carrier. By attaching the grip body 4 with the holder 13 with a screw connection a stable connection between the grip body 4 and the carrier 10 is achieved over the holder 13. Further, the screw holds the first and the second part of the grip body 4 together. When mounted and attached to the carrier 10, the grip body 4 encloses the holder 13.

The base part 11 is provided with a protrusion 30, which is aligned with the central axis ax of the lever arm 2. The protrusion 30 is adapted to be a pivot point for the control ring 5. The arrangement of the protrusion 30 aligned with the central axis ax of the lever arm 2 is enabled through the offset placement of the holder 13.

Figure 3:
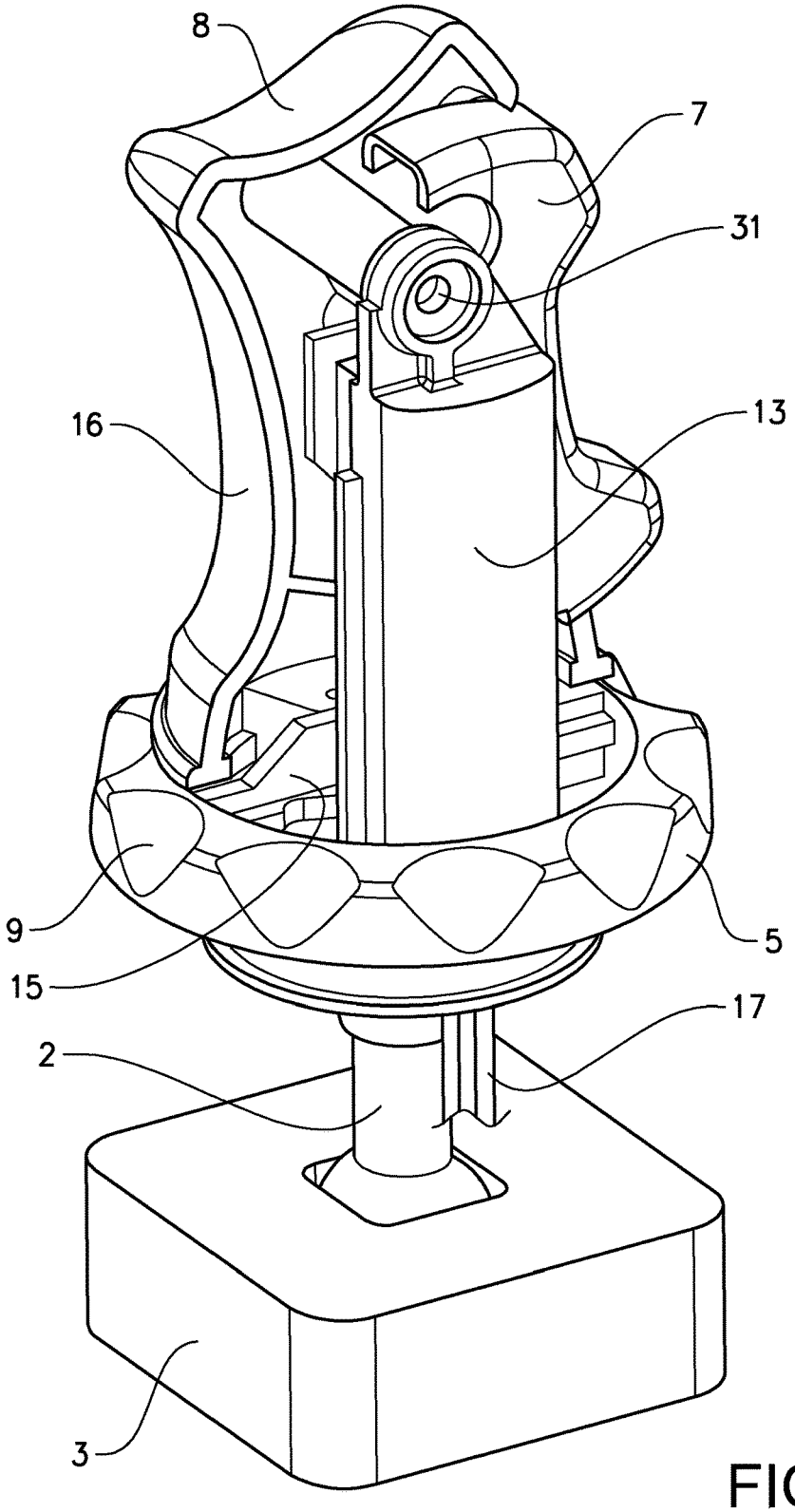
FIG. 3 shows a schematic cross section view of a joystick according to the invention.

In order to stop the control ring 5 from rotating freely, the control ring 5 is provided with a spare 15 such that it can be turned a maximum predetermined angle in each direction (shown in FIG. 3). The spare 15 interact with the guides 12 (shown in FIG. 4) in order to limit the turning angle of the control ring 5. The guides 12 are arranged upon a base part 11, such that the form at least two circle segments, which ideally are arranged symmetrically, such that they have to equal large openings between their ends. Wherein, said openings between the circle segments defines the turning angle of the control ring 5, in that when the control ring 5 is turned the spare 15 will evidently become contact with the end of one of the circle segment.

The grip body 4 is attached to the holder 13, through a screw attachment. In the figures this screw attachment is provided at the upper part of the grip body 4, the placement of the attachment point is however not important for the invention. The grip body 4 could further be attached to the holder 13 with other suitable means, such as form-fitting.

The holder 13 is arranged offset to a rotational axis of the control ring 5. The rocker 7 can thereby be arranged adjacent to the holder 13, and still be centered in a plane parallel with the rotational axis of the control ring 5. Further the offset location of the holder 13, allows the placement of sensing means for both the control ring 5 and the rocker in the holder 13.

It is preferred that the carrier 10 is molded in one piece and the holder 13 comprises potted electronics which comprises sensing means corresponding to the rocker 7 and the control ring 5. The sensing means are connected to a vehicle control unit through wiring 17, which preferably extend from the bottom of the carrier 10.

In order to provide the holder 13 with potted electronics, it is provided with a cavity 35, whereby the sensing means 41, 42 can be arranged therein. The sensing means 41, 42 comprises a first and a second sensor 41, 42. The first sensor 41 senses movements from the rocker 7 and the second sensor senses movements from the control ring 5. According to the invention the first and the second sensor 41, 42 are provided inside the holder 13. And preferably, as shown in the figures arranged upon one and the same circuit board 40. By arranging the first and the second sensor 41, 42 upon the same circuit board an easy connection of the sensors to is facilitated, and the sensors 41, 42 can still be arranged protected inside the elongated holder 13. The base part 11 is provided with an insert opening 51 located at its bottom. During assembly of the joystick the circuit board 40 with the first and the second sensor 41, 42 arranged thereon is inserted through the insert opening 51. The wiring 17 of the circuit board 40 is preferably connected to the end of the circuit board 40 that is closest to the opening 51 when the circuit board 40 is mounted inside the cavity 35. Optionally, as a last step in an assembly of the joystick 1 the insert opening 51 and/or the whole cavity 35 of the holder 13 can be filled with a sealing-filler, whereby only the wiring 17 is extending from the sealing-filler. The electronics of the circuit board 40 can thereby be fully sealed from dirt and moist, i.e. potted in the holder 13.

The use of potted electronics for sensing the operational commands of the rocker 7 and the control ring 5 ensures that the device is resistant to vibrations as well as to moist and dirt.

The circuit board 40 is arranged such in the cavity 35 of the holder 13 that the first and the second sensor 41, 42 are directed towards the central axis ax of the lever arm 2.

The first and the second sensor 41, 42 are arranged in the cavity 35 of the holder 13 such that the senses the movement of the rocker 7 and the control ring 5 respectively. Both the rocker 7 and the control ring 5 are provided with a magnet (not shown) respectively. The magnets (not shown) and the sensors 41, 42 are arranged such relative each other that the magnets are located adjacent with the sensors 41, 42 separated essentially only by a thin wall 33 of the holder 13, which is directed towards the central axis ax of the lever arm 2. The magnets are suitable arranged upon the rocker 7 and the control ring 5, such that when they are actuated by an operator, the magnet performs a corresponding movement in front of the respective sensor 41, 42, whereby the movement of the rocker 7 and the control ring 5 can be sensed and used as control input for a suitable function.

It is preferred that the opposite wall 34 of the holder 13 is thicker in order to increase the structural strength of the holder 13. The holder 13 can be provided with further strengthening means such as ribs or stays in order to provide a proper strength to the holder 13.

A suitable sensor to use in the joystick 1 is Hall sensor.

The circuit board 40 can further be provided with a first and a second electromagnetic shield 43, 44. The first and the second electric magnetic shield is thereby arranged on the back side of the circuit board 40, i.e. the side not provided with the first and the second sensor 41, 42.

By providing the circuit board with electromagnetic shields 43, 44, the sensors 41, 42 are protected from magnetic disturbances from the surrounding/working environment of the joystick 1. The precision of the first and the second sensor 43, 44 sensors regarding sensing movements of the rocker 7 and the control ring 5 respectively is thereby increased.

The base part 11 of the carrier 10 is further provided with an annular groove 50 around its outer circumference. In the annual groove 50 a sealing can be fitted when the joystick 1 is mounted in a maneuvering panel or the like. Due the inventive arrangement of the holder 13 and the sensing means 41, 42 all the electronics can be sealed effectively from the working environment of the joystick 1 with only one sealing arranged in the annular groove 50.

Preferably, the grip body 4 comprises two grip body 4 parts, as shown in FIG. 3, in which one of the grip body parts has been removed. The two grip body 4 parts are secured to each other and the holder 13 through a first hole 31 arranged in the top of the holder 13, i.e. located on the end of the holder 13 furthest away from the base part 11. One part is secured to the carrier 10 in the base part 11 of the carrier 10 through a second through hole 32. The first through hole 31 is arranged such that it does not penetrate the cavity 35 of the holder 13. The cavity 35 is only provided with the opening 51 in the base part 11 of the carrier 10. The base part 11 of the carrier 10 is provided with an opening 22, which is adapted such that the lever arm 2 of the joystick 1 can be fitted therein. When the lever arm 2 is fitted a secured in the opening 22 a fix mounting of the carrier 10 to the lever arm 2 is secured. The grip body 4 of the joystick 1 transfers the maneuvering forces applied on it over to the carrier 10 and there from to the lever arm 2. Through the inventive arrangement of the sensing means 41, 42 in the holder 13 the grip body 4 can be applied with high forces, without affecting the electronics. A stable structure of the holder 13 and a tight connection between the grip body 4 and both the holder 13 and the base part 11 assures a construction of the joystick 1 which can withstand high maneuvering forces.

It is preferred that the cavity 35 of the holder 13 is dimensioned such that the circuit board 40 fits snuggly inside, with or without magnetic shields 43, 44, depending on which is desired. The circuit board 40 and the cavity 35 are thereby adapted to each other that the cavity guides the circuit board 40 into its correct position. If a joystick with the shielding means 43 44 is desired, the cavity 35 is adapted such that the circuit board 40 can be inserted with the shielding means 43, 44 already mounted upon the circuit board 40.

Due to the inventive arrangement of the first and second sensor 41, 42 in the cavity 35 of the holder 13, a few part design of the joystick 1 is achieved. The rocker 7 and the control ring 5 can be assembled without having any separate electronics. All the electronics and sensors 41, 42, are arranged either in the cavity 35 of the holder 13 or below the base part of the carrier 10. The electronics of the joystick can thereby easily be sealed off with only one seal-ring, e.g. arranged between the carrier 10 and a maneuvering panel. Further, the sensors 41, 42 and the circuit board 40 can optionally be even more protected through by filling the cavity 35 with a sealing-filler, after the circuit board 40 has been placed in its correct position in the cavity 35.

Such a potting of the circuit board 40 also protects the circuit board 40 and the sensors from hard impacts and vibrations. The offset arrangement of the holder 13 relative central axis ax of the lever arm 2 enables a central arranged pivot point 30 for the control ring 5, a central arrangement of the rocker 7 upon the grip body 4 and the arrangement of the circuit board 40 with its first and second sensor 41, 42 inside the holder 13.

Reference signs mentioned in the claims should not be seen as limiting the extent of the matter protected by the claims, and their sole function is to make claims easier to understand.

As will be realized, the invention is capable of modification in various obvious respects, all without departing from the scope of the appended claims. Accordingly, the drawings and the description thereto are to be regarded as illustrative in nature, and not restrictive.

The invention claimed is:

1. Joystick for maneuvering of a utility vehicle, wherein said joystick comprises:

a lever arm, a base, a grip body, and a rocker, wherein said lever arm is arranged such that it can tilt relative said base and said grip body is fixedly arranged relative said lever arm, wherein said grip body is provided with a grip portion, which at least facilitates gripping of said grip body with a thumb and an opposite finger, and said rocker is provided in the area of said grip portion and can pivot relative said grip body, wherein a control ring is provided below said grip portion and arranged such that the control ring can pivot relative an axis parallel with the central axis of said lever arm and such that the control ring can rotate relative said grip body, wherein said grip body is provided upon a carrier, wherein said carrier is fixedly attached to said lever arm and comprises a base part, a holder and sensing means, where said holder extends from said base part in a direction parallel to the central axis of said lever arm, said grip body extends from said base part such that it encloses said holder and said grip body is attached to the upper part of the holder, and wherein said sensing means is provided within said holder, and is adapted to sense movement of at least said control ring and said rocker.

2. Joystick according to claim 1, wherein said rocker is arranged to pivot relative a rocker pivot axis, said rocker pivot axis being perpendicular to the central axis of said lever arm.

3. Joystick according to claim 1, wherein said control ring is provided with a spare, such that the control ring from a starting position of the control ring can be turned a maximum predetermined angle in each direction around an axis parallel with a central axis of the lever arm.

4. Joystick according to claim 1, wherein said control ring is provided with a resilient member, which is acting upon said control ring, such that it automatically returns to its starting position.

5. Joystick according to claim 1, wherein said base part is provided with guides guiding the pivoting movement of said control ring.

6. Joystick according to claim 5, wherein a protrusion upon said base part acts as a pivot point for said control ring, said protrusion being aligned with the central axis of said lever arm.

7. Joystick according to claim 1, where said holder is arranged offset from the central axis of said lever arm, and in between said central axis and the outer periphery of said base part.

8. Joystick according to claim 1, wherein said sensing means comprise a first and second sensor, such that the first sensor senses movement of said control rocker and said second sensor senses movement of said control ring.

9. Joystick according to claim 8, wherein said first and second sensors are arranged on a common circuit board, and wherein said first and second sensors are spaced apart such that said first sensor is adjacent to said control rocker and said second sensor is adjacent to said control ring.

10. Joystick according to claim 9, where said first and second sensors are arranged at a side of the circuit board facing the central axis of said lever arm.

11. Joystick according to claim 9, where said circuit board is equipped with magnetic shields arranged at a side of the circuit board facing away from the central axis of said lever arm.

12. Joystick according to claim 9, where a cavity of said holder is dimensioned such that the cavity encloses said circuit board, and such that the circuit board is guided into the cavity upon insertion of said circuit board into said holder.

13. Joystick according to claim 9, where said circuit board is potted inside the holder.

14. Joystick according to claim 9, where the thickness of the wall of the holder directed towards the central axis is sufficiently thin to allow the first and second sensor to sense movements of the control ring and the rocker respectively.

* * * * *